United States Patent [19]

Callander

[11] 4,168,606

[45] Sep. 25, 1979

[54] PROCESS FOR FORMING STRING

[75] Inventor: Douglas D. Callander, Akron, Ohio

[73] Assignee: The Goodyear Tire & Rubber Company, Akron, Ohio

[21] Appl. No.: 801,490

[22] Filed: May 31, 1977

[51] Int. Cl.[2] ..... D02G 3/38; D02G 3/44

[52] U.S. Cl. ..... 57/310; 57/236; 57/282

[58] Field of Search ..... 57/139, 140 R, 140 C, 57/149, 153, 162, 164, 3, 6, 34 HS, 144, 157 R, 157 TS, 157 MS, 236, 241, 242, 287, 288, 292, 310

[56] References Cited

U.S. PATENT DOCUMENTS

| | | | |
|---|---|---|---|
| 2,321,746 | 7/1942 | Heymann | 57/292 X |
| 2,401,291 | 5/1946 | Smith | 57/140 C |
| 2,735,258 | 2/1956 | Crandall | 57/140 C |
| 2,861,417 | 11/1958 | Crandall | 57/140 C |
| 3,018,610 | 1/1962 | Kleinekathofer | 57/157 R |
| 3,024,589 | 3/1962 | Vaughan | 57/149 X |
| 3,050,431 | 8/1962 | Crandall | 57/157 R X |
| 3,309,861 | 3/1967 | Pierson et al. | 57/149 X |
| 3,481,136 | 12/1969 | Timmons et al. | 57/310 X |
| 3,488,934 | 1/1970 | MacDonald | 57/157 R X |
| 3,559,390 | 2/1971 | Staschewski | 57/6 |
| 3,738,096 | 6/1973 | Crandall | 57/140 C X |
| 4,016,714 | 4/1977 | Crandall et al. | 57/149 |
| 4,055,941 | 11/1977 | Rivers et al. | 57/149 |

*Primary Examiner*—Donald Watkins
*Attorney, Agent, or Firm*—J. P. Ward

[57] ABSTRACT

The invention of this application relates to strings for game rackets which are formed of large monofilaments of thermoplastic, fiber-forming resin in which the monofilaments are twisted to form a bundle and two or more bundles are cabled and twisted in the opposite direction from the twist of the bundle, the composite string being oriented and heat set to prevent unravelling of the string. The strings are laced into a game racket such as a tennis racket under a tension of about 50 pounds to form a racket which has good playing properties as well as tensile retention and good resilience retention.

3 Claims, 2 Drawing Figures

PROCESS FOR FORMING STRING

This invention relates to strings for game rackets such as tennis, badminton, squash and the like and to a method for manufacturing strings and rackets of these types and to the rackets strung with these strings.

Racket strings of the prior art have been made of natural gut, nylon and polyester. Such prior art strings have been of the sheath-core type which possess a smooth outer skin over a core which may be a single monofilament or a bundle of twisted filaments. Such strings are generally smooth integrated strings.

Thus in the manufacture of synthetic strings for tennis rackets and the like it has heretofore been common practice to provide a composite string having a thermoplastic core surrounded by a thermoplastic armored sheath, either braided or spirally wound, and then integrating the entire string by various means. In virtually all cases it has been found that to acquire proper integration of a composite string of this type it is necessary to pass the string through a plastic solution subsequent to the application of the sheath to the core, or to apply a sheath to the core while the latter is still soft and tacky.

Now according to the present invention a synthetic string is provided which is not smooth sheath-core type but which is comprised of two or more cords made of large monofilaments, the cords being plied together or twisted together and held in line contact to provide strings which have a convoluted surface that gives the player more control of the flight of the ball when struck by these strings. Unravelling tendency of the twisted string, which especially occurs during the racket stringing process, can be prevented by a heat-setting treatment or by passage of the string through an adhesive dip solution and then drying to cement crossover points in the twisted string construction, while maintaining the desirable convoluted surface.

Figure 2:
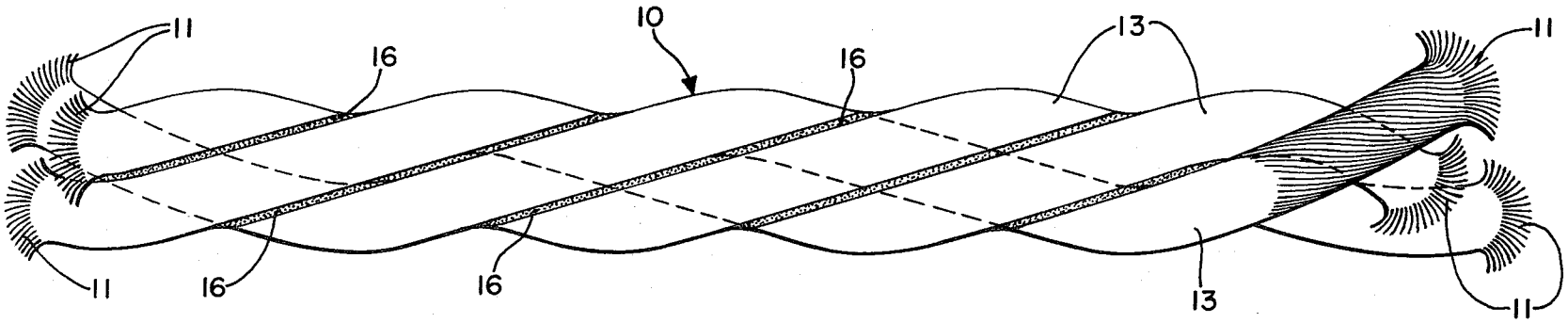
Figure 1:
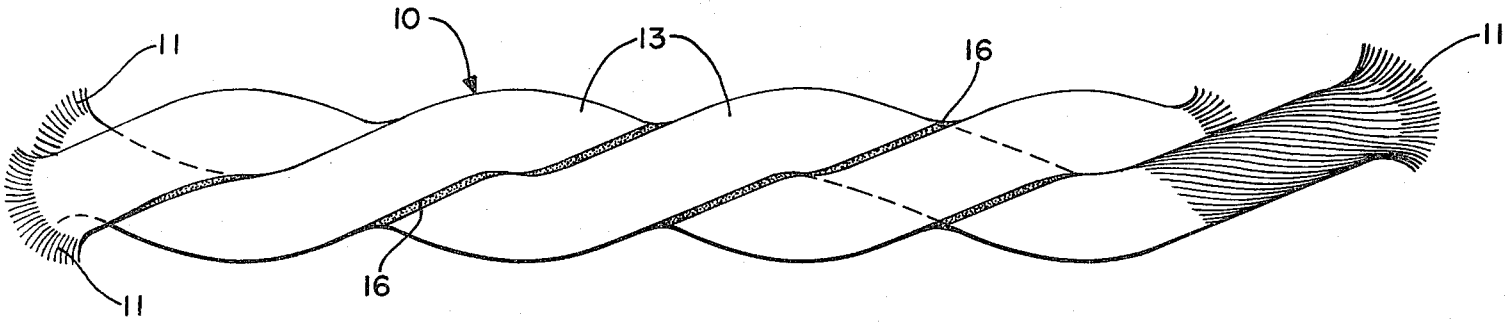

The string 10 of the present invention is illustrated in FIG. 1 and FIG. 2 as being of the multifilament type, the filaments 11 being of a thermoplastic fiber forming polymer such as nylon-6 or 6—6 or polyester. In the illustrated form the filaments 11 which are large monofilaments formed by melt extrusion having a diameter of 16 to 18 mils are cabled in groups of two or three to provide a bundle 13 and then the bundles are cabled or gently twisted to provide a multifilament string 10. The string 10 is heat set or passed through a tank containing a solution of a special adhesive material, dried and then heat set. In practice it has been found that a single pass through the adhesive provides the desired amount of bonding material 16.

The bonding and heat-setting treatment minimize unravelling during stringing of a racket, as well as separation of the filaments during use and helps the monofilaments retain their individual integrity except where bonded. The string is thus provided with an undulating surface that improves or increases the spin imparted to the ball on contact and improves playability performance by giving the player better control over the action of the ball when it is hit with a racket strung with these new strings.

The adhesive used in the above example is a 20 percent (weight/volume) solution of a 60/40 ethylene terephthalate-ethylene isophthalate copolyester resin in methylene dichloride. The resin had an intrinsic viscosity of 0.5 as determined in a 60/40 phenol-tetrachloroethane mixture at 30° C. This dip bath can be suitably used in conjunction with a Litzler dip unit. A single pass gives sufficient pick-up to cement crossover points. Excessive adhesive application yields an undesirable "hairiness" effect on stringing the racket.

The monofilaments used in the strings of the invention are large monofilament having a diameter of from about 10 mils to about 30 mils. They are made by melt spinning a thermoplastic fiber forming polymer such as nylon or polyester such as polyethylene terephthalate through a spinnerette having appropriately sized holes according to usual spinning practice for such filaments. The filaments are oriented to provide tensile strength, tensile retention and resiliency.

The strings of the present invention can be used in rackets suitable for various games such as tennis, badminton, squash, etc. The frame of the racket can be of wood or of metal such as aluminum or steel. Stringing is accomplished in the usual way by arranging the strings in the form of a net, usually with square open mesh and with the strings under a tension of 45 to 55 pounds.

The strings of the invention have a number of advantageous properties. They are easy to string into a racket. The strings slide easily over each other at crossover points and they do not unravel where they turn across sharp bends. They have good response to impact and have a percentage rebound of about 70 percent for a tennis ball dropped vertically through a free fall distance of five feet striking the strings in the face of the racket held at a 90° angle to the line of fall of the ball. Rackets strung with the strings of the invention have a very acceptable performance in play and it is thought that they allow the player to have more control of the ball.

While certain representative embodiments and details have been shown for the purpose of illustrating the invention it will be apparent to those skilled in this art that various changes and modifications may be made therein without departing from the spirit or scope of the invention.

What I claim is:

1. A game racket strung with a string of from 45 to 60 mils in diameter and having a convoluted surface and consisting of at least one bundle of at least two polyethylene terephthalate monofilaments, said monofilaments ranging from 8–30 mils in diameter and wherein said string is prepared by orienting said monofilaments to provide tensile strength, tensile retention and resiliency then combining and twisting together said oriented monofilaments into the bundle forming the string and then heat setting the string so formed.

2. The game racket of claim 1 wherein the string has a denier of at least 14,000 and a breaking strength of 100 pounds at 20 percent elongation.

3. A game racket strung with a string having a convoluted surface said string characterized by consisting of a bundle of three large polyethylene terephthalate monofilaments (3×27 mils (0.69 millimeter)), wherein said string is prepared by a method comprised of orienting said monofilaments to provide tensile strength, tensile retention and resiliency and then combining and twisting together said monofilaments at 3.5 turns per inch into the bundle forming the string and then heat setting the string so formed in an oven, said string further being characterized by having a diameter of about 54 mils (3.7 millimeters) and a breaking strength greater than 100 pounds at an elongation of 20 to 40 percent.

* * * * *